US006440010B1

(12) United States Patent
Deshmukh

(10) Patent No.: US 6,440,010 B1
(45) Date of Patent: Aug. 27, 2002

(54) GOLF CLUB HEAD WITH WEIGHTING MEMBER AND METHOD OF MANUFACTURING THE SAME

(75) Inventor: Uday V. Deshmukh, Oceanside, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 09/683,197

(22) Filed: Nov. 29, 2001

Related U.S. Application Data

(62) Division of application No. 09/584,623, filed on May 31, 2000.

(51) Int. Cl.[7] ..... A63B 53/04

(52) U.S. Cl. ..... 473/335; 473/349; 473/350

(58) Field of Search ..... 473/324, 290, 473/291, 334, 335, 336, 337, 338, 339, 340, 341, 342, 345, 346, 347, 348, 349, 350

(56) References Cited

U.S. PATENT DOCUMENTS 4,071,354 A 1/1978 Mocarski
4,092,223 A 5/1978 Kaufman
4,382,818 A 5/1983 Mocarski
4,591,481 A 5/1986 Lueth
4,931,241 A 6/1990 Freitag
4,992,236 A * 2/1991 Shira
5,000,779 A 3/1991 German et al.
5,098,469 A 3/1992 Rezhets
5,154,425 A * 10/1992 Niskanen
5,217,227 A * 6/1993 Shira
5,261,664 A * 11/1993 Anderson
5,441,553 A 8/1995 Polizzotti et al.
5,584,770 A * 12/1996 Jensen
5,776,010 A 7/1998 Helmstetter et al.
5,833,551 A * 11/1998 Vincent
5,863,492 A 1/1999 Bose
5,938,543 A * 8/1999 McGeeney
6,027,010 A 2/2000 Shira
6,030,294 A 2/2000 Shira

* cited by examiner

*Primary Examiner*—Sebastiano Passaniti
(74) *Attorney, Agent, or Firm*—Michael A. Catania

(57) ABSTRACT

The use of hot pressing for weighting of a golf club head is disclosed herein. The preferred weighting material is a multiple component material that includes a high-density component and a binding component. A preferred multiple component material includes tungsten and tin. The hot pressing process is performed in an open air environment at standard atmospheric conditions.

9 Claims, 9 Drawing Sheets

GOLF CLUB HEAD WITH WEIGHTING MEMBER AND METHOD OF MANUFACTURING THE SAME

CROSS REFERENCE TO RELATED APPLICATIONS

This application is a divisional application of co-pending U.S. patent application Ser. No. 09/584,623, filed on May 31, 2000.

FEDERAL RESEARCH STATEMENT

[Not Applicable ]

BACKGROUND OF INVENTION

1. Field of the Invention

The present invention relates to a golf club. More specifically, the present invention relates to a golf club with a weighting member composed of multiple materials.

2. Description of the Related Art

Golf club designs are constantly evolving with the primary purpose to improve a golfer's performance. While the improvements may address a number of areas, a designer strives to design a more forgiving golf club. Forgiveness in a golf club may be achieved by shifting the center-of-gravity of a golf club to a desirable location, and creating a larger moment of inertia.

It is difficult to increase forgiveness in a golf club head composed of a homogeneous or monolithic material, such as stainless steel, since there is a limit on the overall weight of a golf club acceptable to the typical golfer. To overcome this difficulty, designers have resorted to combining different materials (high density and low density) to achieve the desired center-of gravity and large moment of inertia. A very high-density material provides a designer with the greatest freedom in improving the performance of a golf club head since less volume is needed to achieve the proper weighting. The most economical, commercially available material with a very high density is tungsten, which has a density of 19.3 grams per cubic centimeter.

One challenge in using heterogeneous materials is the ability to join the materials together in a golf club head. Numerous techniques have been created by the golf industry to join heterogeneou materials in a golf club head. One example is the GREAT BIG BERTHA® TUNGSTEN-TITANIUM™ irons, developed by the Callaway Golf Company of Carlsbad, Calif., which used a screw to attach a tungsten block to the rear and sole of a titanium iron. Another example is the GREAT BIG BERTHA® TUNGSTEN-INJECTED™ HAWK EYE ® irons, also developed by the Callaway Golf Company, which feature an internal cavity with tungsten pellets in a solder, as set forth in U.S. Pat. No. 6,210,290, for an Internal Cavity Tungsten Titanium Iron, filed on Jun. 11, 1999. An example of a wood is the GREAT BIG BERTHA® HAWK EYE® drivers and fairway woods, also developed by the Callaway Golf Company, which use a tungsten screw in the sole of a titanium club head body. Other techniques use adhesives to join the materials, press fit the materials, braze the materials, or structurally hold one material piece within another material piece using undercuts or pockets.

For the most part, these techniques require a precisely machined weighting piece to fit within a precise location on a golf club head. The most economical method is to cast a golf club head body with a cavity for the weighting piece and attaching the weighting piece with a screw. However, casting tolerance are low, and require either machining of the cavity itself, or machining of the weighting piece to fit each cavity. The use of softer materials is undesirable since this creates difficulty in finishing the final product due to smearing of such soft materials during grinding of the golf club head.

Further, a co-casting process, where the weighting piece is incorporated in the mold prior to pouring the base metal, is very problematic depending on the materials since the weighting piece is relatively cold when the hot liquid base metal is cast around it causing thermal shock. Also, thermal expansion mismatch of materials is a problem with co-casting of heterogeneous materials. Other problems arise during reshafting, where the golf club head is heated to remove the shaft. Such heating will result in low melting temperature materials (epoxies and solder) to flow, resulting in the possible movement of weighting pieces.

SUMMARY OF INVENTION

The present invention allows for a golf club head to be easily weighted without precisely machined weighting components. The present invention is able to accomplish this by forming a weighting member composed of a multi-component material into the golf club head by applying pressure to the multi-component material while it is in a cavity of the golf club head.

The most general aspect of the present invention is a golf club head with a body and a weighing member. The body has a striking plate, a heel end, a toe end and a cavity. The weighting member is composed of a multicomponent material and is disposed in the cavity of the body.

Another aspect of the present invention is a cavity back golf club head having a body and a weighting member. The body has a striking plate, a toe end, a heel end and a main rear cavity opposite the striking plate. A top wall, a bottom wall, a heel wall and a toe wall define the main rear cavity. The bottom wall has a second cavity with a predetermined configuration. The weighting member is disposed within the second cavity and occupies the entire cavity. The weighting member is composed of a multi-component material.

Yet another aspect is a method for manufacturing a golf club head. The method includes introducing a multi-component powder/pellet mixture into a cavity on a body of a golf club head, and applying a predetermined amount of force to the multi-component powder/pellet mixture to compact the multi-component powder/pellet mixture within the cavity and form a weighting member. The multi-component powder/pellet mixture may also be heated to a predetermined temperature for hot pressing of the multi-component powder/pellet mixture within. The predetermined temperature is above or closest to the melting temperature of one component of the multi-component powder/pellet mixture.

The multi-component powder/pellet mixture may be composed of a high-density component and a binder component. One variation of the multi-component powder/pellet mixture may be composed of tungsten and tin, or alternatively composed of tungsten and a tin bismuth material.

Having briefly described the present invention, the above and further objects, features and advantages thereof will be recognized by those skilled in the pertinent art from the following detailed description of the invention when taken in conjunction with the accompanying drawings.

DETAILED DESCRIPTION

Figure 1:
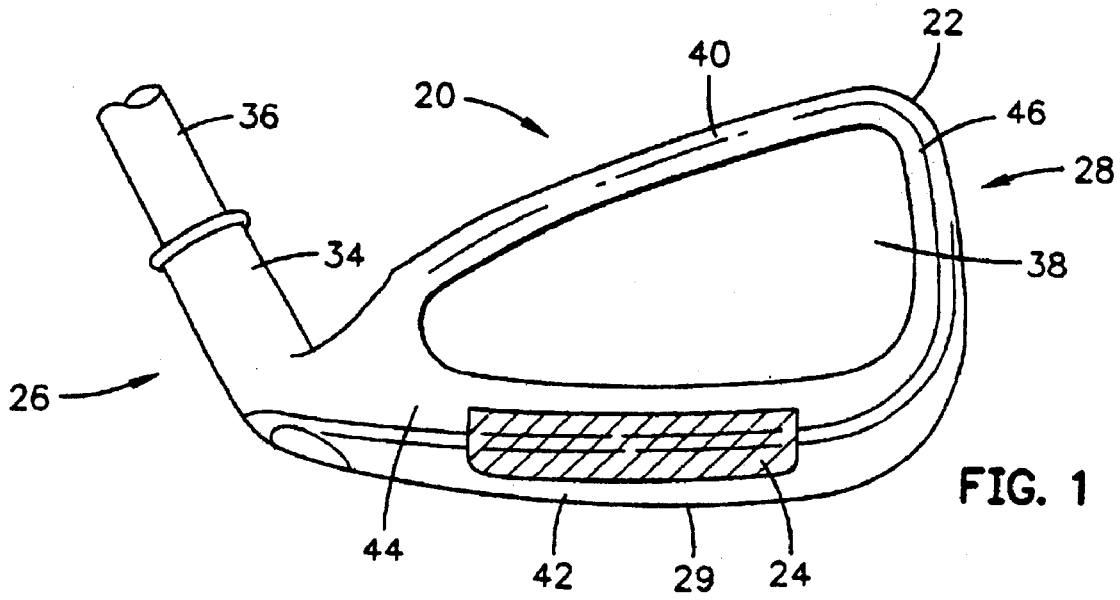
FIG. 1 is a rear plan view of a golf club head of the present invention.
Figure 2:
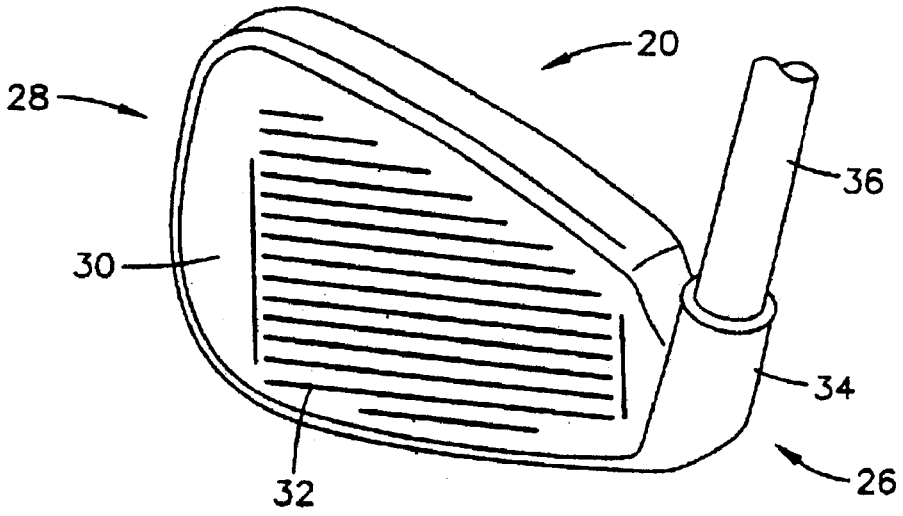
FIG. 2 is a front plan view of the golf club head of FIG. 1.
Figure 3:
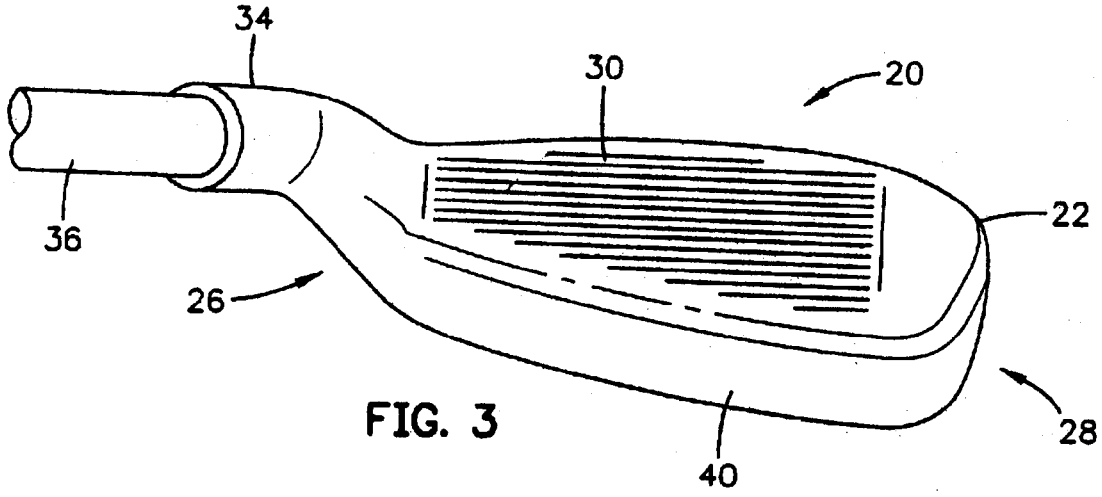
FIG. 3 is a top perspective view of the golf club head of FIG. 1.
Figure 4:
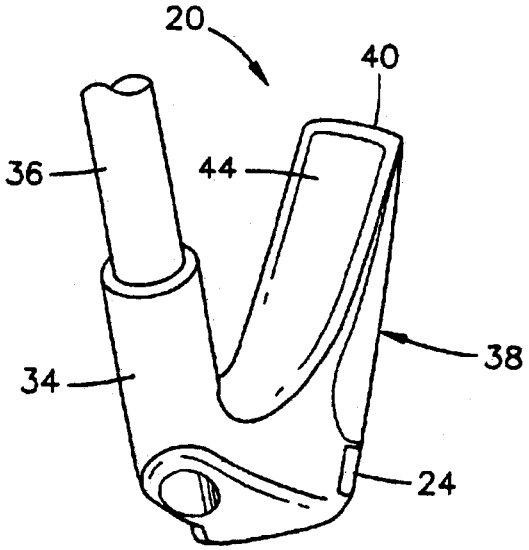
FIG. 4 is a heel end perspective view of the golf club head of FIG. 1.
Figure 5:
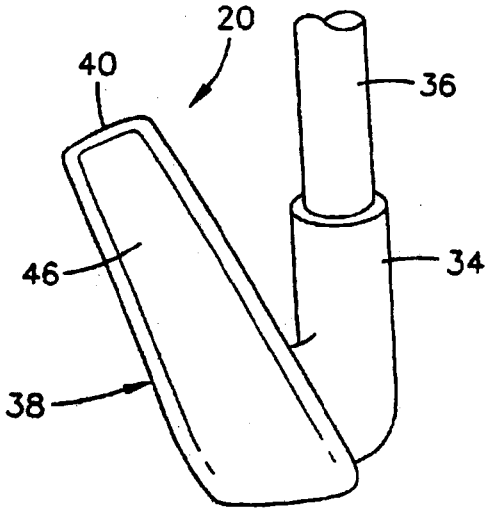
FIG. 5 is a toe end perspective view of the golf club head of FIG. 1.
Figure 6:
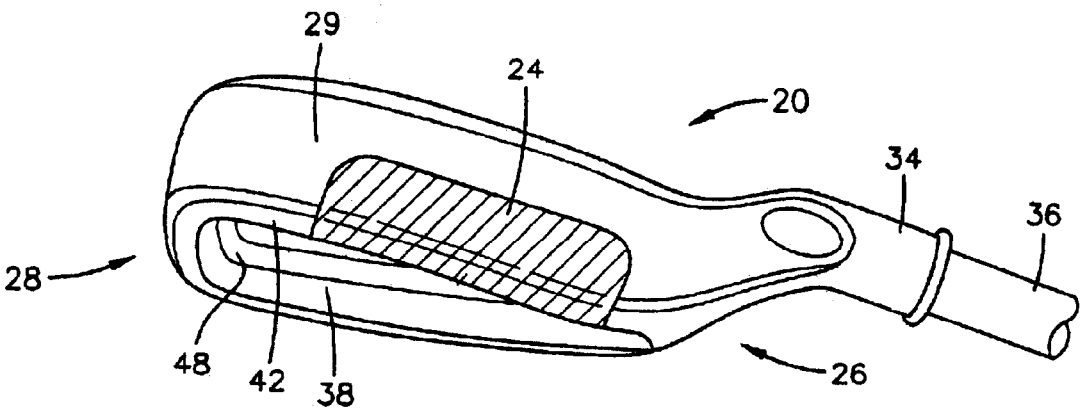
FIG. 6 is a bottom perspective view of the golf club head of FIG. 1.

As shown in FIGS. 1–7, a golf club head is generally designated 20. The golf club head 20 is a cavity-back iron with a body 22 and a weighting member 24. The golf club head 20 has a heel end 26, a toe end 28 and a sole 29. On the front of the body 22 is a striking plate 30 that has a plurality of scorelines 32 therein. A hosel 34 for receiving a shaft 36 is located on the heel end 26 of the golf club head 20. The rear of the golf club head 20 has a main cavity 38 that is defined by a top wall 40, a bottom wall 42, a heel wall 44 and a toe wall 46. The golf club head 20 also has an optional undercut recess 48 circumventing and openly exposed to the main cavity 38.

Figure 7:
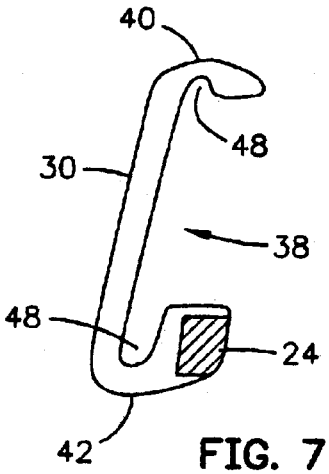
FIG. 7 is a cross-sectional view of the golf club head of FIG. 1 along line 7—7.
Figure 7A:
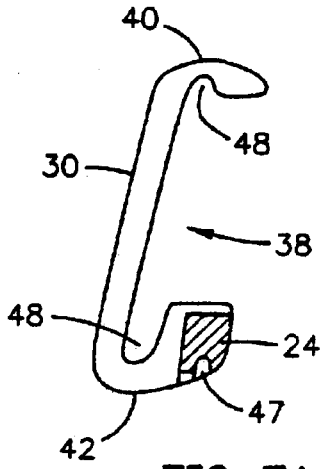
Figure 7B:
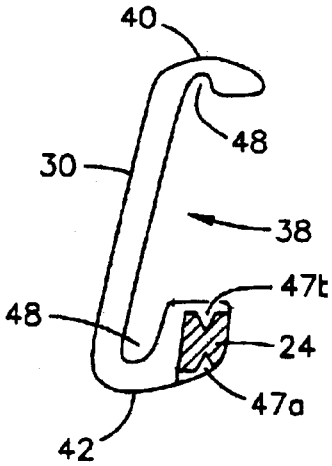

The weighting member 24 is composed of a multiple component powder or pellet mixture that is pressed within a cavity 25 (shown in FIG. 11) of the body 22. The cavity 25 is preferably open to the sole 29 and the bottom wall 42. However those skilled in the pertinent art will recognize that the cavity 25, and hence the weighting member 24, may be disposed in numerous locations to provide a desired affect. As shown in FIG. 7, the weighting member 24 locates a large percentage of the mass of the golf club head 20 in the lower center of the golf club head 20 thereby lowering the center of gravity of the golf club head 20 to make it more forgiving for a golfer.

Figure 8:
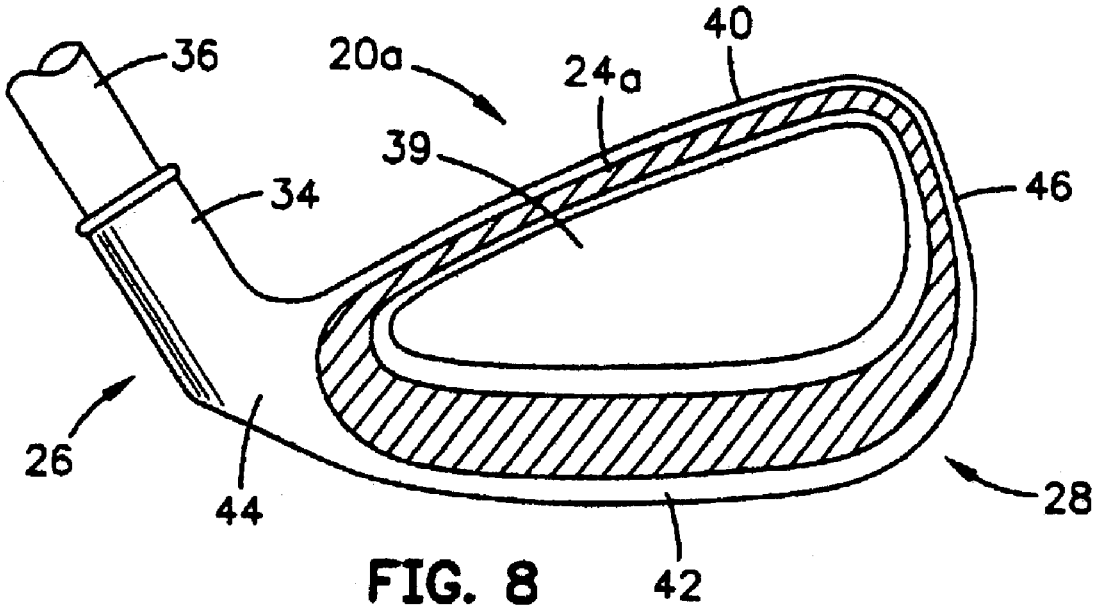
FIG. 8 is a rear plan view of an alternative embodiment of the golf club head of the present invention.
Figure 9:
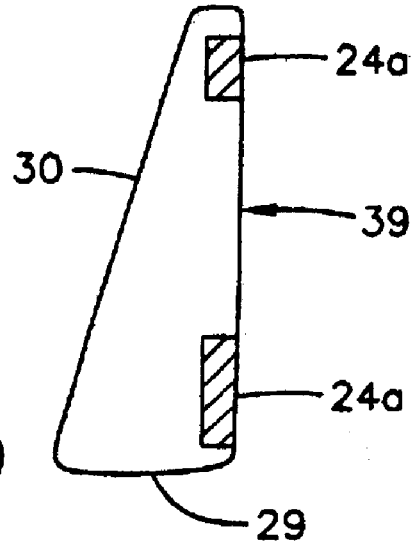
FIG. 9 is a cross-sectional view of the golf club head of FIG. 8 along line 9—9.

An alternative embodiment of the golf club head 20*a* of the present invention is illustrated in FIGS. 8 and 9. The golf club head 20*a* is a blade-style iron as compared to the cavity-back iron of FIGS. 1–7. The golf club head 20*a* of FIGS. 8 and 9 does not have a cavity 38, nor does it have an undercut 48. The weighting member 24*a* is disposed annularly about the rear 39 of the body 22. Further, the cavity 25*a* containing the weighting member 24*a* is open only to the rear 39 and not the sole as in the previous embodiment. The annular weighting member 24*a* allows for the blade style golf club head 20*a* to have perimeter weighting similar to a cavity-back iron, and thus the forgiveness of a cavity-back iron while having the traditional appearance of a blade iron. The annular weighting member 24*a* will occupy a greater volume of the golf club head 20*a* than the weighting member 24 of FIGS. 1–7, and thus will also have a greater percentage of the mass of the golf club head 20*a*. The weighting member of the present invention may occupy various contoured cavities of golf club heads due to its unique manufacturing method.

Figure 10:
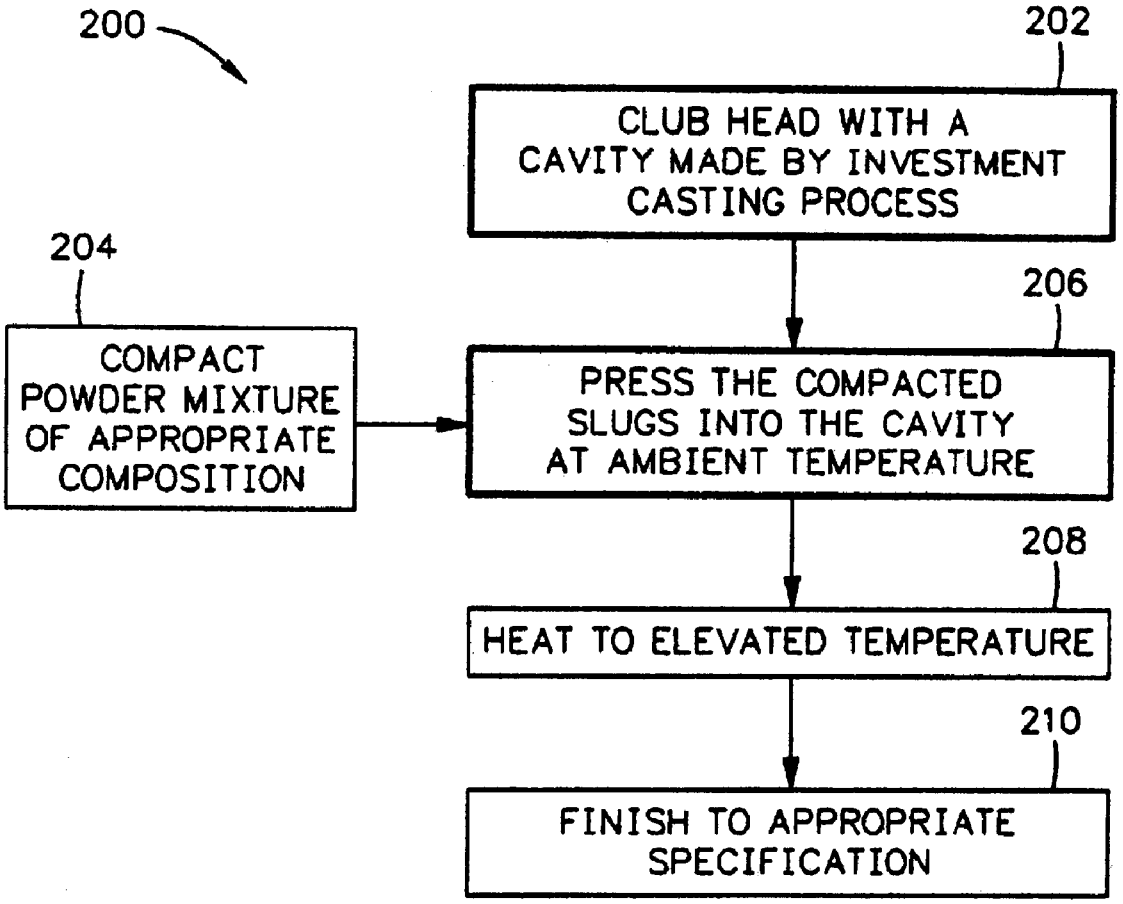
FIG. 10 is a flow chart of the process of the present invention.
Figure 11:
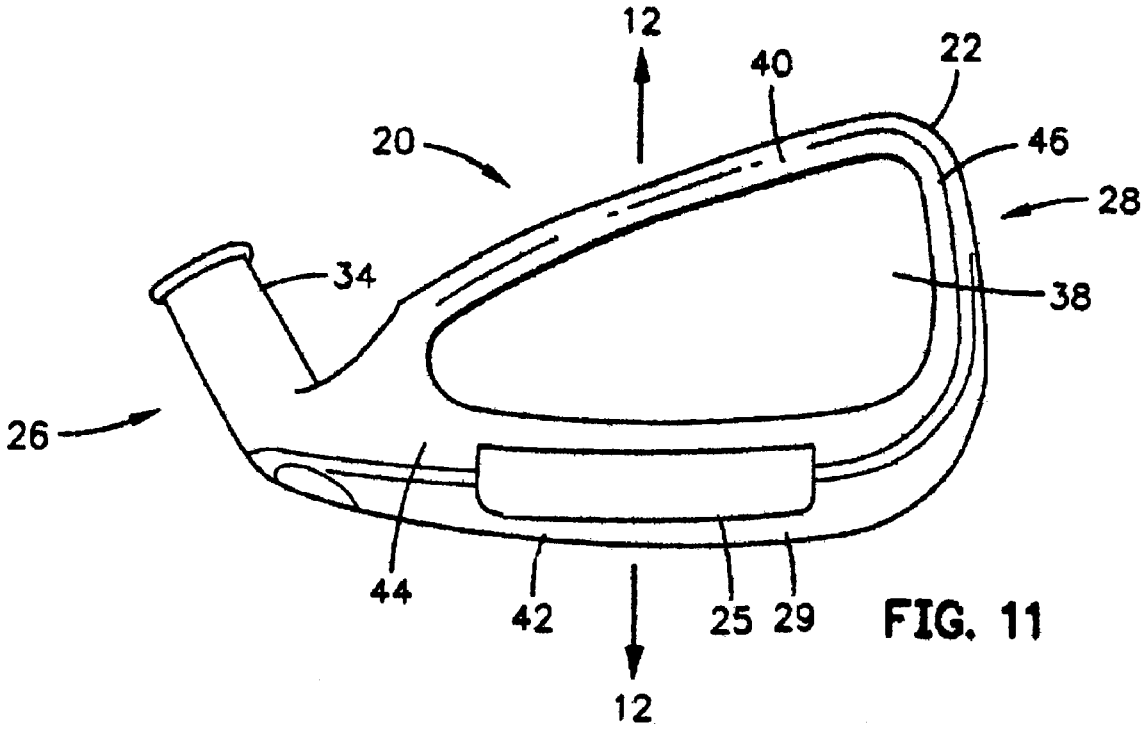
FIG. 11 is a rear plan view of an unfinished golf club head of the present invention.
Figure 12:
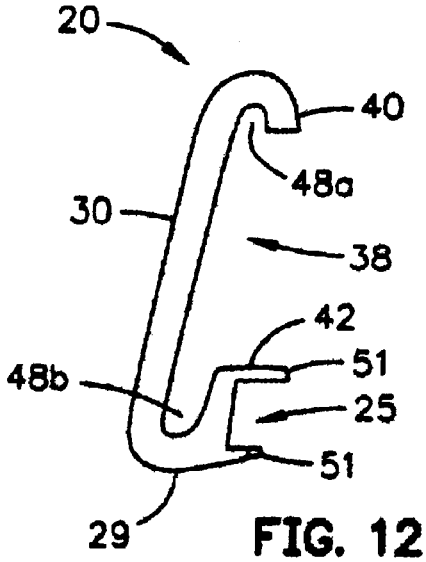
FIG. 12 is a cross-sectional view of the unfinished golf club head of FIG. 11 along line 12—12.

FIG. 10 illustrates a flow chart of the process of the present invention for producing a golf club head 20 or 20*a* with a weighting member 24 or 24*a* composed of a multiple component powder or pellet mixture. The process 200 begins with providing a golf club head 20, preferably prepared by a conventional investment casting process at block 202. However, those skilled in the pertinent art will recognize that the golf club head 20 or 20*a* may be prepared through other techniques well know in the golf industry, such as forging. The golf club head 20 may be composed of stainless steel, titanium, titanium alloys, zirconium, zirconium alloys, copper, nickel, cobalt alloys, or like materials. The golf club head 20 is cast to have a cavity 25, as shown in FIG. 11, and preferably has a lip 51, as shown in FIG. 12, for containing the mixture. The lip 51 is removed during the finishing process. The cavity 25 has a predetermined volume according to the amount of mass needed from the weighting member 24 for the golf club head 20. At block 204, the precursor powder materials for the multiple component powder or pellet mixture are compacted for placement into the cavity 25. The mixture may be composed of powders, pellets or a mixture thereof. The precursor powder or pellet materials are composed of a high-density component in various particle sizes (ranging from 1.0 mm to 0.01 mm) for achieving low porosity for the weighting member 24. The preferred high-density component is tungsten which has a density of 19.3 grams per cubic centimeter (g/cm$^3$), however other high-density materials may be used such as molybdenum (10.2 g/cm$^3$), tantalum (16.7 g/cm$^3$), platinum (21.4 g/cm$^3$), gold (19.3 g/cm$^3$), silver (10.3 g/cm$^3$), and the like. Additionally, high-density ceramic powders may be utilized as the high-density component. The amount of high-density component in the mixture may range from 5 to 95 percent of the volume of the weighting member 24.

In addition to a high-density component such as tungsten, the multiple component powder or pellet mixture is composed of a binding component such as tin (density of 7.31 g/cm$^3$) or other comparable material. The binding component in the multiple component powder or pellet mixture may range from 4 to 50 percent of the volume of the weighting member 24. The overall density of the weighting member 24 will range from 11.0 g/cm$^3$ to 17.5 g/cm$^3$, preferably between 12.5 g/cm$^3$ and 15.9 g/cm$^3$, and most preferably 15.4 g/cm$^3$.

Figure 13:
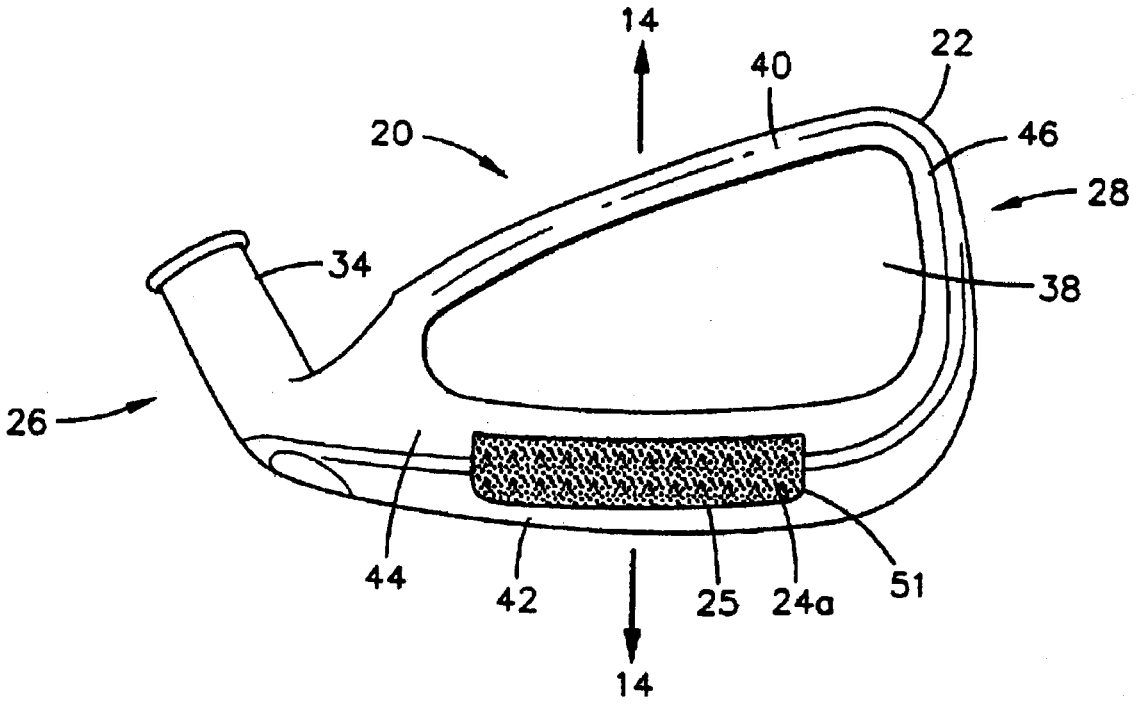
FIG. 13 is a rear plan view of the unfinished golf club head of FIG. 11 with the powder precursor material therein.
Figure 14:
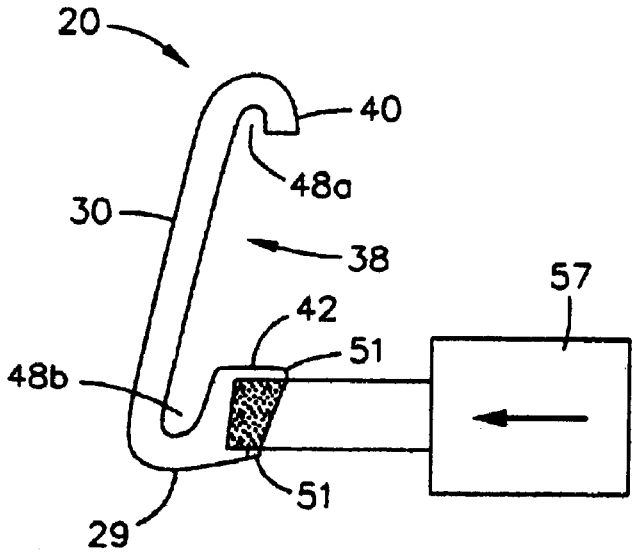
FIG. 14 is a cross-sectional view of the unfinished golf club head of FIG. 13 along line 14—14 with a punch engaged therewith.

Returning to FIG. 10, the powders are thoroughly mixed to disperse the binding component throughout the multiple component powder or pellet mixture. The multiple component powder or pellet mixture may be pre-compacted into slugs for positioning and pressing within the cavity 25 at block 206, and as shown in FIG. 13. Higher densities are achieved by pre-compacting the multiple component powder or pellet mixture prior to placement within the cavity 25. At block 206, the mixture is pressed within the cavity 25 at a pressure between 10,000 pounds per square inch (psi) to 100,000 psi, preferably 20,000 psi to 60,000 psi, and most preferably 50,000 psi. As shown in FIG. 14, a punch 57 is used to exert the pressure on the mixture to compact the mixture to form the weighting member 24.

Once the multiple component powder or pellet mixture is pressed within the cavity 25, at block 208 the unfinished golf club head **20*b* may optionally be placed within a furnace for heating of the multiple component powder or pellet mixture under standard atmospheric conditions and in air. More precisely, the process of the present invention does not require a vacuum nor does it require an inert or reducing environment as used in the liquid phase sintering processes. In the furnace, the multiple component powder or pellet mixture is heated for 1 to 30 minutes, preferably 2 to 10 minutes, and most preferably 5 minutes with the punch 57 maintaining a constant pressure on the mixture. The furnace temperature for melting at least one component of the mixture is in the range of 300° F. to 550° F., and is preferably at a temperature of approximately 450° F. The one component is preferably the binding component, and it is heated to its melting temperature to liquefy as shown in FIG. 14. However, those skilled in the art will recognize that the temperature may vary depending on the composition of the multiple component powder or pellet mixture. Preferably the binding component is tin, and the hot pressing occurs at 450° F. to allow the tin to fill in the cavities of the multiple component powder or pellet mixture to reduce porosity and thus increase the density of the weighting member 24**. As the tin liquefies, the tungsten (melting temperature of 3400° C.), or other high-density component, remains in a powder form.

At block 210, the unfinished golf club head with the weighting member 24 therein is finished through milling, grinding, polishing or the like. The lip 51 is removed at this stage of the process. Those skilled in the art will recognize that the density of the weighting member 24 will change depending on the particular club within a set of irons, or fairway wood or putter. The density is manipulated through modifying the amount of binding component, such as tin, and varying the pressure and temperature as shown in FIGS. 17–19.

Figure 17:
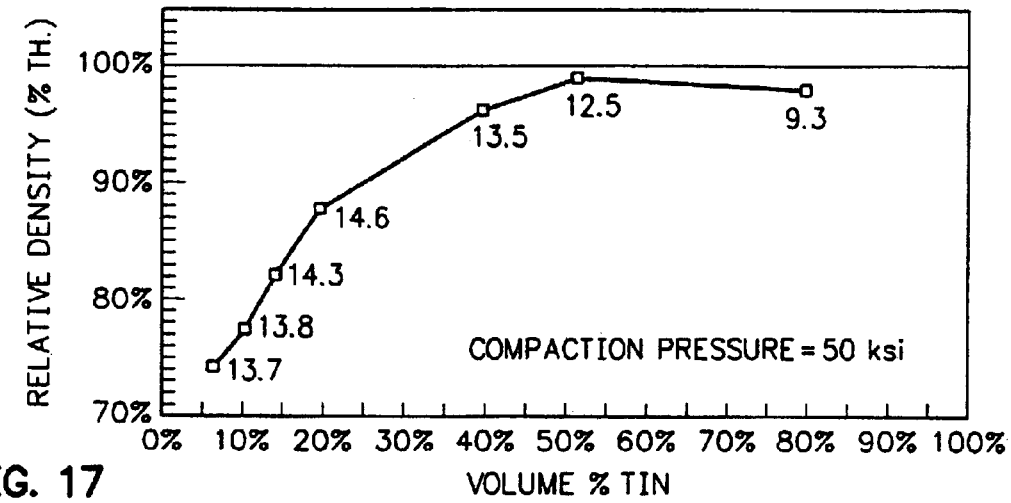
FIG. 17 is a graph of Relative Density versus Volume percent of tin.
Figure 18:
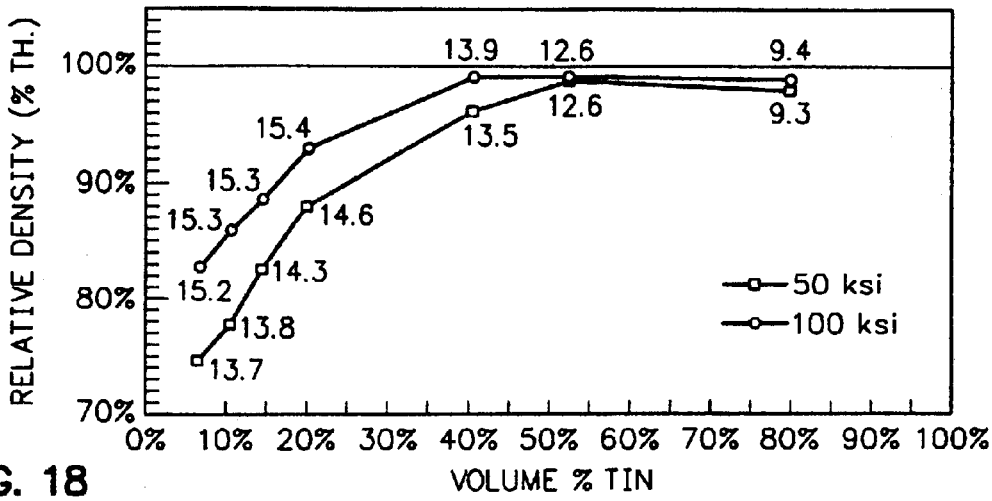
FIG. 18 is a graph of Relative Density versus Volume percent of tin.
Figure 19:
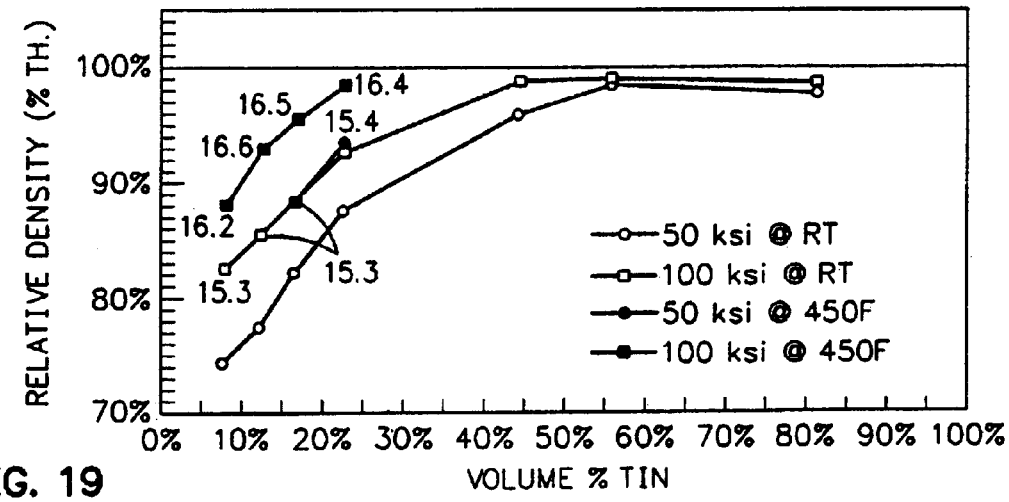
FIG. 19 is a graph of Relative Density versus Volume percent of tin.

FIGS. 17–19 illustrate graphs of the compositions of the multiple component powder or pellet mixture, at different compositions and under different pressures and temperatures. The y-axis of each is the Relative Density that is the percent of theoretical or expected density achieved by the measured density. The processing was conducted at standard atmospheric conditions (1 atmosphere) and in air. The theoretical or expected density is the density if mixture was processed in a reducing environment under high pressure. The present invention is able to achieve between 70% to 99% of the theoretical density by using a method that does not require a reducing environment and high pressures.

FIG. 17 illustrates the Relative Density versus the volume of tin in the mixture of just tin and tungsten (disregarding porosity) that undergoes pressing at 50,000 psi. The highest density, 14.6 g/cm$^3$, is achieved at 22% volume tin whereas the highest relative density (99%), 12.5 g/cm$^3$, is achieved at 50% volume tin.

FIG. 18 illustrates the Relative Density versus the volume of tin in the mixture of just tin and tungsten (disregarding porosity) that undergoes pressing at 50,000 psi and 100,000 psi. The highest density, 15.4 g/cm$^3$, is achieved at 22% volume tin whereas the highest relative density, 99% (13.9 g/cm$^3$), is achieved at 40% volume tin, and at 100,000 psi.

FIG. 19 illustrates the Relative Density versus the volume of tin in the mixture of just tin and tungsten (disregarding porosity) that undergoes pressing at 50,000 psi and 100,000 psi, and is processed at room temperature and at 450° F. The highest density, 16.6g/cm$^3$, is achieved at 12% volume tin whereas the highest relative density, 99% (16.4 g/cm$^3$), is achieved at 25% volume tin, at 100,000 psi and at a temperature of 450° F. FIG. 19 illustrates that hot pressing provides a weighting member 24 that has the highest density and, the highest relative density.

Figure 15:
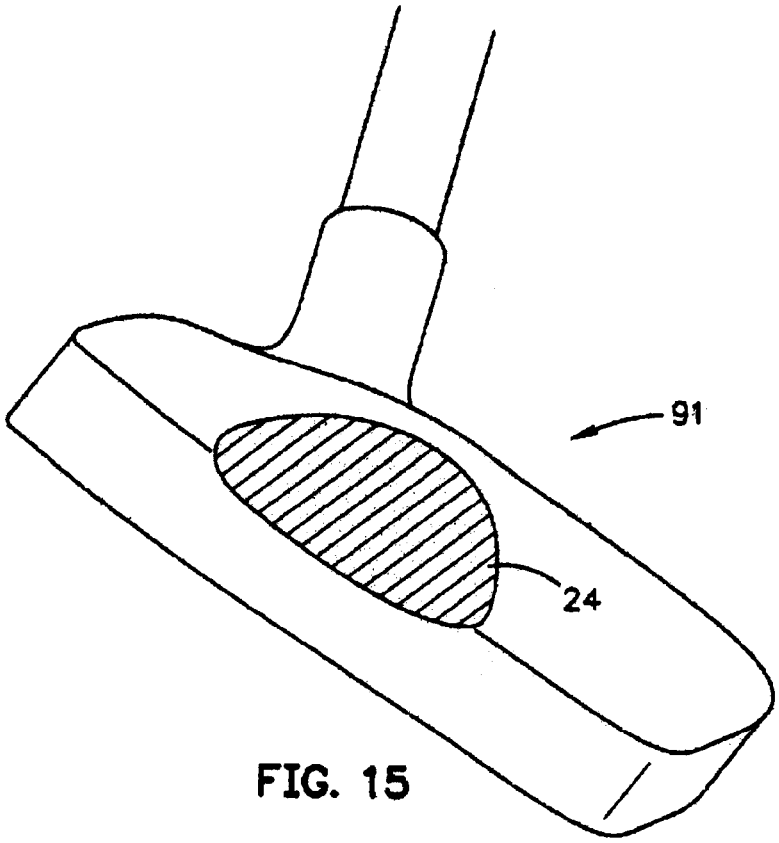
FIG. 15 is a view of a putter golf club head.
Figure 16:
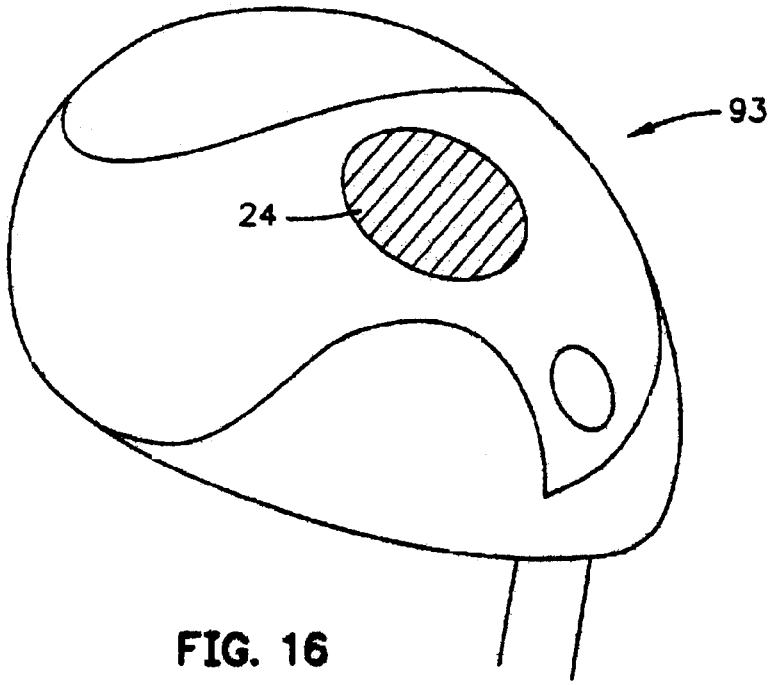
FIG. 16 is a view of a wood golf club head.

Although the present invention has been described in reference to irons, those skilled in the pertinent art will recognize that the present invention may be utilized with putter heads 91 and wood heads 93 as illustrated in FIGS. 15 and 16 respectively.

From the foregoing it is believed that those skilled in the pertinent art will recognize the meritorious advancement of this invention and will readily understand that while the present invention has been described in association with a. preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim:

1. A golf club comprising:

a body with a striking plate, a heel end, a toe and a cavity; and a weighting member formed in the cavity of the body, the weighting member composed of a pressed multiple component powder material consisting essentially of tungsten in an amount of 50 to 95% volume of the multiple component powder material and tin in an amount of 5 to 50% volume of the multiple component powder material, wherein the weighting member has a density ranging from 15.5 g/cm$^3$ to 16.7 g/cm$^3$, wherein the weighting member has a density that is 80% to 90% of the theoretical density of the multiple component powder material, wherein the weighting member has a porosity that is less than 10% of the volume of the weighting member.

2. The golf club head according to claim 1 wherein the golf club head is an iron.

3. The golf club head according to claim 1 wherein the golf club head is a driver, fairway wood or a putter.

4. The golf club head according to claim 1 wherein the golf club head is a blade iron and the weighting member is an annular structure about the rear wall of the blade iron opposite a striking plate of the blade iron.

5. The golf club head according to claim 1 wherein the tungsten component is 80–90 volume percent of the weight member and the tin is 10–20 volume percent of the weight member.

6. The golf club head according to claim 1 wherein the tungsten component is approximately 78 volume percent of the weight member and the tin is approximately 22 volume percent of the weight member, and the density is approximately 16.0 g/cm$^3$.

7. An iron-type golf club head comprising:

a body having a striking plate, a toe end, a heel end, a main rear cavity opposite the striking plates the main rear cavity defined by a top wall, a bottom wall, a heel wall and a toe wall, the bottom wall having a second cavity with a predetermined configuration, and a weighting member formed within the second cavity and occupying the entire cavity, the weighting member composed of a pressed multiple component powder material consisting essentially of tungsten in an amount of 80%–90% volume of the multiple component powder material and tin in an amount of 10%–20% volume of the multiple component powder material, where the weighting member has a density ranging from 15.5 g/cm$^3$ to 16.7 g/cm$^3$, wherein the weighting member has a density that is 80% to 99% of the theoretical density of the multiple component powder material, wherein the weighting member has a porosity that is less than 10% of the volume of the weighting member.

8. The golf club head according to claim 7 wherein the main rear cavity further comprises an undercut recess into at least one of the top wall, bottom wall, toe wall or heel wall.

9. The golf club head according to claim 7 wherein the body is composed of material selected from the group consisting of titanium, titanium alloy, steel, zirconium, zirconium alloy, nickel, nickel alloy, copper and copper alloy.

* * * * *